United States Patent [19]

Taylor

[11] 4,014,249

[45] Mar. 29, 1977

[54] PNEUMATICALLY ACTUATED SANDING TOOL

[75] Inventor: James O. Taylor, Manalapan, Fla.

[73] Assignee: Florida Pneumatic Manufacturing Corporation, Boynton Beach, Fla.

[22] Filed: Sept. 18, 1975

[21] Appl. No.: 614,677

[52] U.S. Cl. ..... 91/32; 91/234; 92/136; 92/184; 51/170 TL

[51] Int. Cl.[2] ..... F01L 21/02

[58] Field of Search ..... 91/234, 32; 92/136, 92/182, 184; 51/170 R, 170 TL

[56] References Cited

UNITED STATES PATENTS

| | | | |
|---|---|---|---|
| 841,162 | 1/1907 | Lewis | 91/234 |
| 1,940,388 | 12/1933 | Callahan | 91/234 |
| 2,610,098 | 9/1952 | Reiners | 92/182 |
| 2,797,664 | 7/1957 | Swanson | 91/234 |
| 3,606,930 | 9/1971 | Curington | 91/234 |
| 3,713,365 | 1/1973 | Goodrich | 92/136 |
| 3,803,773 | 4/1974 | Pdowara | 51/170 TL |
| 3,838,741 | 10/1971 | Pepe | 91/234 |

FOREIGN PATENTS OR APPLICATIONS

| | | | |
|---|---|---|---|
| 295,776 | 8/1928 | United Kingdom | 91/234 |

*Primary Examiner*—Paul E. Maslousky
*Attorney, Agent, or Firm*—Larson, Taylor & Hinds

[57] ABSTRACT

A fluid actuated, valveless sanding tool is disclosed which comprises a housing containing a cylinder, a double-ended piston mounted for reciprocal movement within the cylinder, a mounting plate to which an abrasive tool can be attached, and a double rack and pinion connecting means reciprocally driving the mounting plate. A fluid supply system delivers pressurized fluid to a central portion of the bore and a vent system permits venting of the ends of the cylinder. The piston has two end seals and three internal, main seals which maintain a fluid tight relationship with the inner cylinder wall. Two internal passages in the piston are in communication with the annular areas between the three main seals and the respective ends of the piston. The end seals alternately cover the corresponding vents for the cylinder ends thereby permitting the piston to be reciprocally driven by the pressurized fluid which has been alternately delivered from the fluid supply system at the central portion of the cylinder to the other respective end portions of the cylinder through the internal passages in the piston itself. Hence the reciprocating piston serves as its own pressurized fluid directing valve.

5 Claims, 7 Drawing Figures

RUN POSITION

START POSITION

STOP POSITION

PNEUMATICALLY ACTUATED SANDING TOOL

BACKGROUND OF THE INVENTION

1. Field of the Invention

The present invention generally relates to a fluid operated sanding machine. More particularly, the present invention relates to a straight line sanding machine of the type employing a reciprocating piston driven by pneumatic fluid pressure.

2. Description of the Prior Art

The prior art is replete with examples of pneumatically driven sanding machines of the type employing reciprocating double-ended piston driven by compressed air which is alternately directed to the respective ends of the piston. These devices employ a valve for repeatedly, first directing the air to one end of the piston and then to the other end of the piston. The valve is normally operated by the reciprocating piston itself. Examples of sanding machines of this general type are disclosed in U.S. Pat. Nos. 3,214,823; 3,399,494; 3,563,134; 1,940,388; 2,610,098; 2,797,614; 3,606,930; and 3,713,365, and in British Patent 295,776, located in Class 91, subclass 234.

The use of a valve to control the flow of air to the piston of the air motor in the prior art machines, however, has several inherent disadvantages. In addition to having a more complex design, the prior art machines are heavier and more expensive. Furthermore, the service life of these machines is decreased because of failures in the valve operation.

In addition, sanders of the type having a single, doubleacting piston often experience starting difficulties. These problems are usually the result of the piston having a tendency to stop in a dead center position in which the air inlet ports at the ends of the piston are blocked by the piston itself. Consequently, starting air cannot be directed to either end of the piston and the machine remains in a stalled condition. When this has occurred, the normal procedure for starting the machine is to physically position the sanding plate, which in turn moves the piston itself. If this is done, however, with the machine starting valve open, the sudden activation of the piston could cause injury to the user.

SUMMARY OF THE INVENTION

The present invention provides a fluid operated sander which overcomes these and other disadvantages of the prior art devices. A sander in accordance with the present invention is light weight, relatively small, and has a simplicity in design which assures a relatively long and trouble free service life. The present invention does not require a valve for alternately directing the motive fluid to the respective ends of the piston. Instead, drilled passages in the piston itself are used to alternately direct the motive fluid to the ends of the piston. The elimination of the air directing valve of the prior art devices permits a more efficient utilization of the motive fluid and eliminates much air leakage. Consequently, a greater developed force is obtained with the present invention for the same fluid pressure than that obtained for other prior art devices. In addition, the elimination of the air directing valve permits a higher operating speed, expressed in strokes per minute, because the speed of a device according to the present invention is not limited by a relatively slow operating mechanical valve operated through mechanical linkage. Finally, a device according to the present invention can have the same operating speed whether loaded or unloaded, and uses a smaller operating fluid consumption than prior art devices.

A fluid actuated, portable sanding tool in accordance with the present invention comprises a housing having a cylinder with a bore therein, means for supplying a pressurized fluid to a supply port in communication with the bore, and means for exhausting at least two vent ports in communication with the bore at corresponding ends of the cylinder. A double-ended piston is slidably mounted for reciprocal movement within the cylinder. The piston has first, second and third circumferential main sealing means axially mounted along the piston for providing three fluid tight seals between the piston and the inner surface of the cylinder. The main sealing means thereby define a first and second annular region. The piston further has a first and second port in communication respectively with the first and second annular regions and has a third and fourth port in communication with the bore at respective first and second ends of the cylinder. A first passage in the piston connects the first and third ports and a second passage in the piston connects the second and fourth ports. The sanding tool further comprises a starting means for displacing the piston toward one end of the cylinder such that one of the first and second ports will be in communication with the fluid supplying means. A mounting plate is mounted for reciprocal motion on the housing of the sanding tool and a connecting means connects the piston to the mounting plate for reciprocally driving the mounting plate. Thus, the piston is reciprocally driven by the pressurized fluid which has been alternately delivered from the supply means to respective ends of the bore by the first port, the first passage, and the third port and by the second port, the second passage, and the fourth port.

These and other objectives and advantages of the present invention will be further explained in or be apparent from the drawings and the discussion of the presently preferred embodiments contained hereinbelow.

DESCRIPTION OF THE PREFERRED EMBODIMENTS

Reference is now made to the various figures of the drawings in which like numerals denote like elements in the figures.

Figure 1:
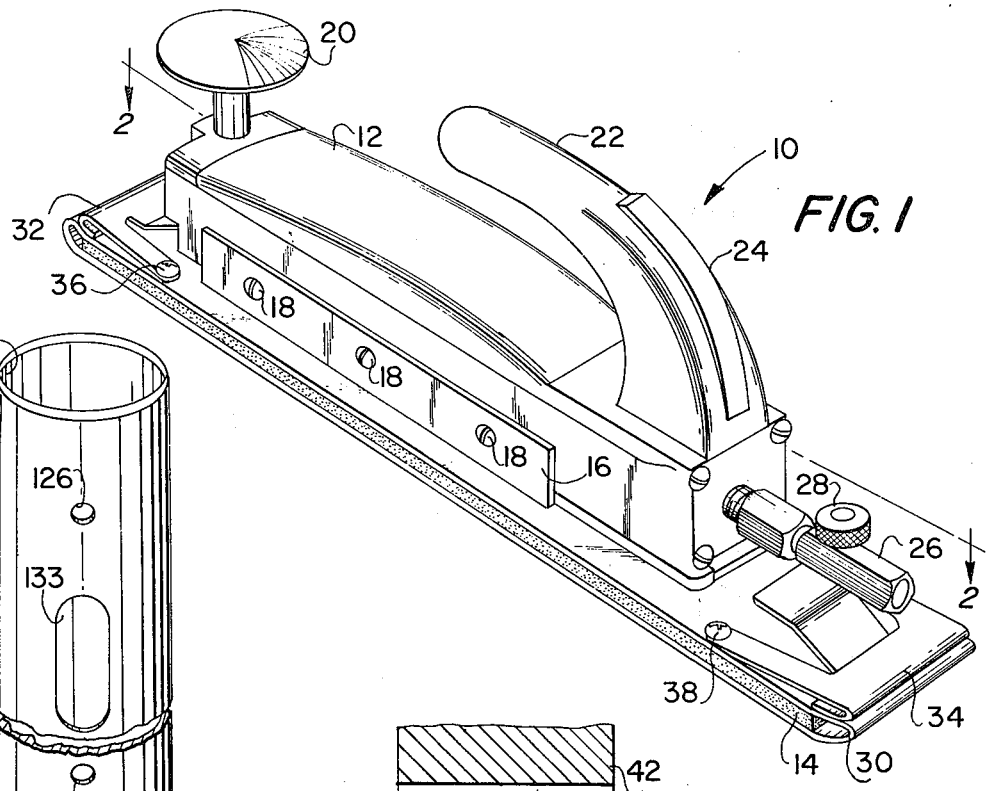
FIG. 1 is a perspective view of one embodiment of a fluid actuated portable sanding tool in accordance with the invention.

A presently preferred embodiment of a fluid actuated portable straight line sander in accordance with the invention is shown at 10 in FIG. 1. Sander 10 is comprised of a housing 12 and a mounting shoe or plate 14 for mounting an abrading tool such as a file, a sanding tool, sand paper, or a rubbing tool. Mounting plate 14 is slidably mounted to housing 12 with side plates 16. Side plates 16 are rigidly mounted to the side of housing 12 with screws 18 and comprise a lower flange [not shown] for receiving a corresponding and mating flange [also not shown] extending upwardly from mounting plate 14. On the top side of housing 12 is rigidly mounted a front handle 20 in the form of a knob and a partially hollow rear handle in the shape of an inverted "L". Mounted within and extending above the top surface of rear handle 22 is a trigger 24 for operating the main fluid throttle valve. Because the preferred fluid for operating sander 10 is air, the latter term is used throughout the subsequent description of the preferred embodiments of the invention, but no limitation is intended thereby. An air inlet fitting 26, which includes an air stop valve 28 operated by the operator supplies air to sander 10.

In the embodiment of the invention shown in FIG. 1, sander 10 has been adapted to use sand paper. Mounting plate 14 is comprised of a sanding plate 30. An elongated rectangular piece of sand paper [not shown] can be rigidly secured to sanding plate 30 with a forward spring clip 32 and a rearward spring clip 34, which are, in turn, respectively rigidly mounted on the top of mounting plate 14 with screws 36 and screws 38.

Figure 3:
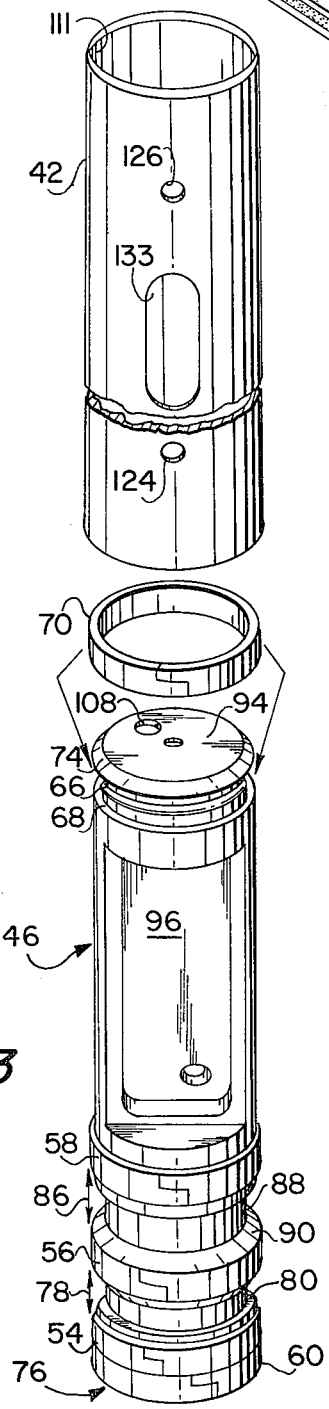
FIG. 3 is an exploded perspective view of the air actuated double-ended piston and cylinder of the embodiment of the invention shown in FIG. 1.
Figure 2:
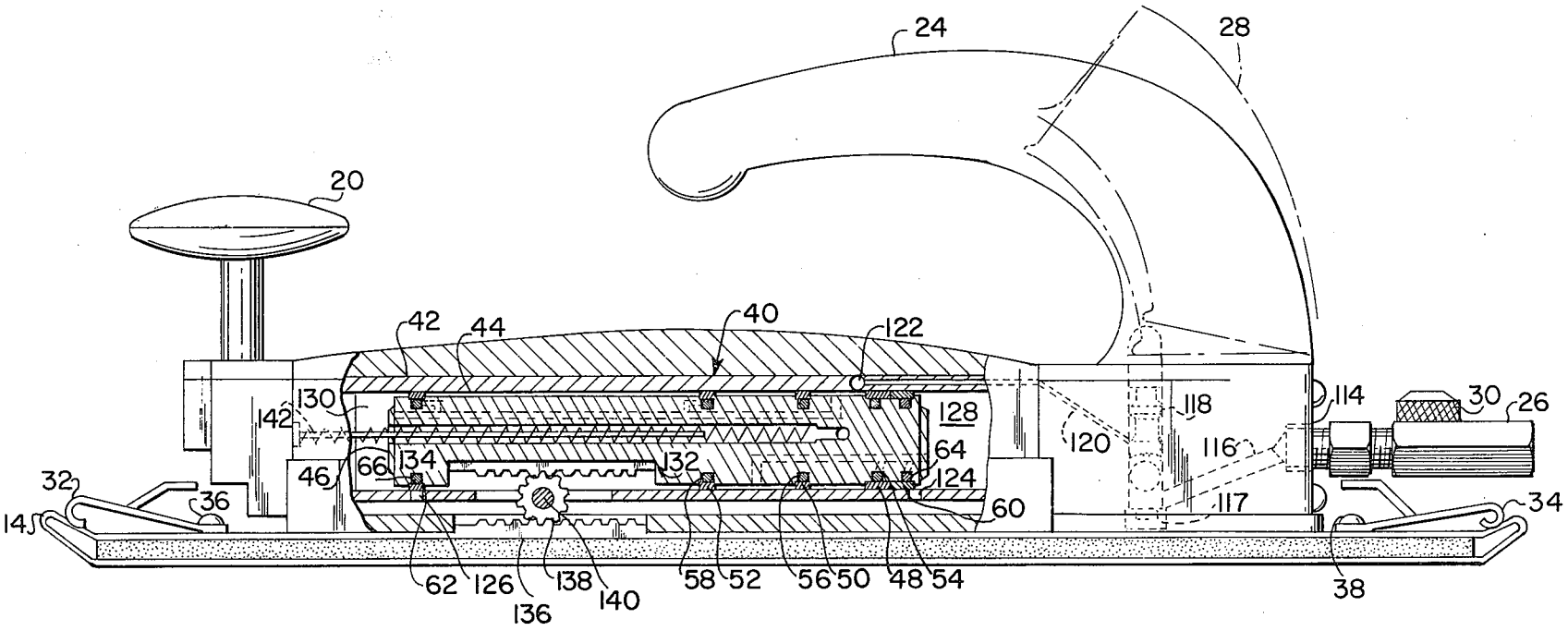
FIG. 2 is a sectional side elevational view taken along line 2—2 of FIG. 1.

As shown in more detail in FIGS. 2 and 3, mounting plate 14 is reciprocally driven by an air motor 40 located inside of housing 12. Air motor 40 is comprised of a cylinder 42 which has a bore therein and fluid end tight seals [not shown] located at each end. A double-ended piston 46 is slidably mounted for reciprocal movement within cylinder 42. Three circumferential main seals 48, 50, and 52 are mounted on piston 46 within annular slots 54, 56, and 58, respectively, and extend radially, outwardly therefrom. First and second circumferential end seals 60 and 62 are located at respective ends of piston 46 in respective annular slots 64 and 66. Both the three main seals 48, 50, and 52 and the two end seals 60 and 62 are comprised of an inner O-ring 68 and a split seal ring 70 mounted coaxially over O-ring 68. Each seal abuts the inner surface 71 of cylinder 42 for providing a slidable sealing contact therewith.

Figure 4:
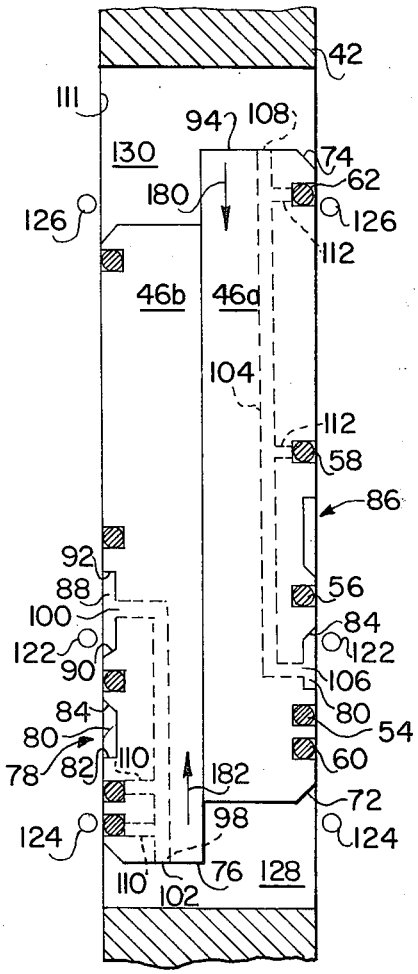
FIG. 4 is a diagram showing one half of the piston at its furthermost point of travel in the cylinder and beginning the return trip and showing the other half of the piston at the other furthermost point of travel in the cylinder and beginning the return trip.

The external shape of piston 46 is shown more clearly in FIGS. 3 and 4. Each end of piston 46 has a beveled edge 72 and 74, respectively, the purpose of which is explained hereinbelow. Located near a first end 76 of piston 46 are main seals 48, 50 and 52, and end seal 60 which abuts main seal 54 on the inward side thereof and beveled edge 72 on the outward side thereof. Main seals 54 and 56 define therebetween a first annular region 78 in which there is located an annular slot 80 in piston 46. Slot 80 is defined at its end proximate to main seal 54 by a substantially vertical wall 82 extending radially inward, and at the end proximate main seal 56 by a beveled wall 84 extending angularly in an inward radial direction away from main seal 56. Similarly, main seals 56 and 58 define a second annular region 86 therebetween in which piston 46 has an annular slot 88. Slot 88 is defined at its end proximate main seal 56 by a beveled wall 90 extending angularly in an inward radial direction away from main seal 56. The other end of slot 88, proximate main seal 58, is defined by a substantially vertical wall 92 extending radially inward. Between end seal 62, located at a second end 94 of piston 46 and main seal 58 is a relatively large slot 96. Slot 96 comprises approximately half of the axial length of piston 46. Mounted within slot 96 is a connecting means, described hereinbelow, for connecting piston 46 to mounting plate 14 for reciprocally driving mounting plate 14.

Located within piston 46 are a plurality of passages for alternately feeding compressed air to ends 76 and 94 of piston 46, thereby reciprocally driving piston 46. A first passage 98 connects a port 100 located in slot 88 with an end port 102 located in first end 76 of piston 46. A second passage 104 connects a port 106 in slot 80 with a port 108 in second end 94 of piston 46. A pair of additional passages 10 connect passage 98 with end seal 60 and main seal 54 for supplying pressurized air thereto for expanding seal rings 70 into contacting and sealing relationship with the inner surface 171 of cylinder 42. Further additional passages 112 connect passage 104 with end seal 62 and main seal 58 for a similar purpose.

Referring again to FIG. 2, compressed air is supplied through air inlet fitting 26 to a main supply port 114 in housing 12 at the rearward end thereof. A passage 116 connects main supply port 114 to an inlet plenum 117 of an air stop and throttle valve 118. Valve 118 is actuated by depressing operator 28. Air stop and throttling valve 118 is of a type well known in the art and is constructed such that the further operator 28 is depressed, the greater the flow of air is permitted through the valve. A supply passage 120 communicates between valve 118 and an air supply port 122 located in cylinder 42 at a mid-portion thereof. Air supply port 122 communicates with either first annular region 78 or second annular region 86, depending upon the axial position of piston 46 in cylinder 42. Vent ports 124 and 126 are located at respective ends in cylinder 42 for respectively venting the spaces on end chambers 128 and 130 defined by the end portions of the inner surface 171 of cylinder 42, the corresponding cylinder end seals, and the corresponding ends 76 and 94 of piston 46. Vent ports 124 and 126 are located in cylinder 42 such that only one vent port is uncovered at a time by piston 46.

The reciprocating motion of piston 46 is transmitted to mounting plate 14 through a connecting means 132, as shown in FIG. 2. Connecting means 132 is comprised of an upper rack 134 rigidly mounted in slot 96 of piston 46 and a lower rack 136 rigidly mounted to mounting plate 14. A pinion 138 is rotatably mounted on a shaft 140 which in turn is rigidly mounted on housing 12. Pinion 138 engages both upper rack 134 and lower rack 136 and thereby transfers the longitudinal movement of upper rack 134 and piston 46, which is in one direction, to the lower rack 136, thereby longitudinally driving rack 136 in the other longitudinal direction.

A starter means such as helical spring 142 resiliently urges piston 46 toward the end of cylinder 42 defining end chamber 128. Spring 142 has a relatively small spring constant such that the force exerted by the spring is relatively small compared with the force exerted on end 76 of piston 46 by the compressed air admitted to end chamber 128. Consequently, spring 142 does not have a tendency to impede or dampen the reciprocal motion of piston 46. However, spring 142 does exert a sufficient force on piston 46 such that when sander 10 is not being used and no air is being admitted to air supply port 122, piston 46 is displaced a sufficient amount such that slot 88 and port 100 in piston 46 is in communication with air supply port 122. Therefore, spring 142 prevents piston 46 from coming to rest with main seal 54 blocking air supply port 122, thereby causing sander 10 to be in a stalled condition when it is subsequently started.

Figure 5:
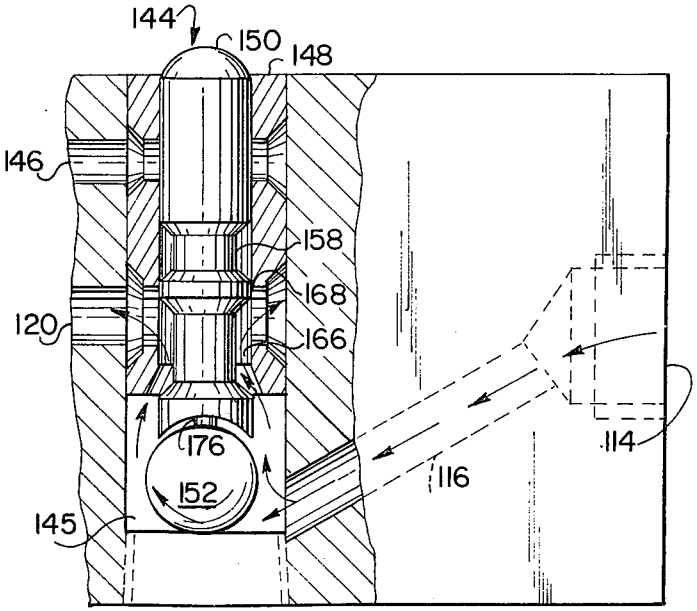
FIG. 5 is a sectional elevational view of the throttle valve of a second embodiment of the invention with the valve being shown in the RUN position.
Figure 6:
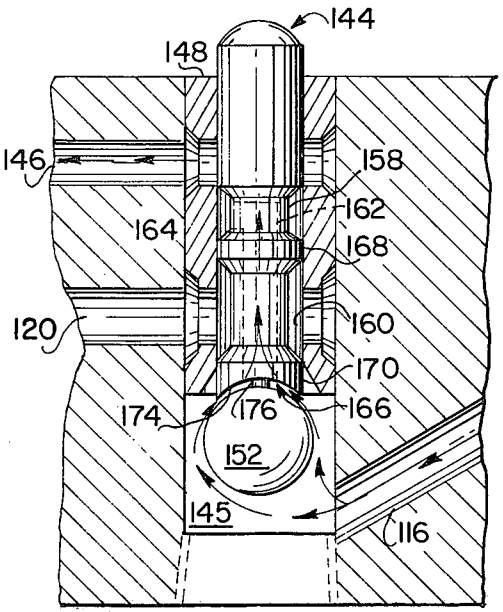
FIG. 6 is a sectional elevational view similar to FIG. 5 with the valve shown in the START position.
Figure 7:
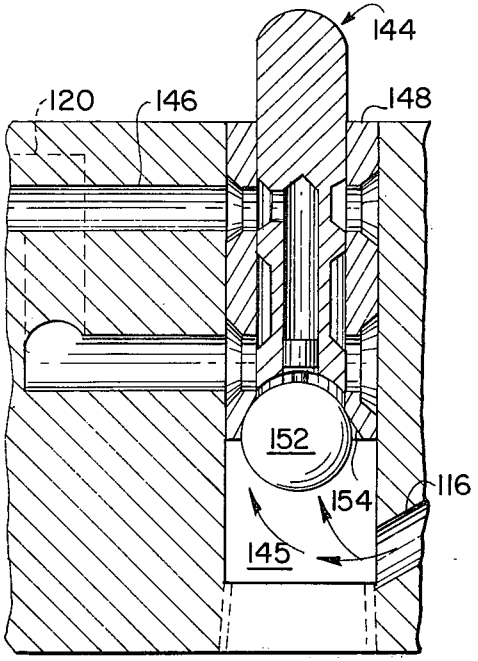
FIG. 7 is a sectional elevational view similar to FIG. 5 with the valve shown in the STOP position.

A second embodiment of the invention, in which the starter means comprises a valve, is shown in FIGS. 5 through 7. In this embodiment of the invention an air stop, starting and throttling valve 144 directs compressed air entering the valve body from main supply port 114 and passage 116 to either a starting air passage 146 or to supply passage 120. Valve 144 is comprised of a cylindrical housing 148 and a spool 150 slidably mounted therein. Spool 150 is comprised of a lower spherical or ball section 152 which, in the stop position as shown in FIG. 7, engages a beveled lower edge 154 of cylindrical housing 148, thereby preventing air from passing into either supply passage 120 or starting air passage 146. Spool 150 further comprises a main body section 156 which has two annular slots, an upper slot 158 and a lower slot 160, axially spaced therein by an annular dividing section 168 which sealingly engages the inner wall of cylindrical housing 148. An internal passage 162 communicates with an upper port 164 located in upper slot 158 and a lower port 166 located in the lower end of body section 156 and above ball section 52. The lower part of the body section 156 of spool 150 is comprised of an annular section 170 which extends radially outwardly in sealing engagement with the lower inner surface of cylindrical housing 148. Lower end 174 of body section 156 has an outwardly concave shape which is spaced from and connected to ball section 152 with a connecting member 176.

When valve 144 is in the start position, as shown in FIG. 6, spool 150 is axially depressed slightly within cylindrical housing 148 such that ball section 152 is no longer in sealing engagement with beveled lower edge 154 of cylindrical housing 148 but with annular section 170 still in sealing engagement with the lower inner surface of cylindrical housing 148. Hence, air is admitted around ball section 152, through passage 162 and upper port 164, and then into starting air passage 146. Starting air passage 146 is connected to one end of piston 46. Thus, the compressed air is directed to one end of piston 46 to urge the piston in the other direction, thereby assuring that one of slots 80 and 88 will be in communication with supply port 122. As spool 150 is depressed further, the upper portion of the spool completely blocks starting air passage 146 thereby preventing further delivery of air thereto. As shown in FIG. 5, when valve 144 is in the RUN position, annular dividing section 168 is positioned just above the top of supply passage 120 and the lower slot 160 is in communication with both supply passage 120 and the supply panel 145. Thus, the compressed air is directed to supply passage 120 and air supply port 122.

To operate sander 10, a compressed air supply is connected to air inlet fitting 26 and operator 28 is positioned to open its corresponding air stop valve and admit air to the main air stop throttle valve 118, in the first embodiment of the invention, or air stop, starting and throttling valve 144, in the second embodiment of the invention. Trigger 24 is then depressed to admit air to supply passage 120 and to air supply port 122.

Referring to FIG. 4, one half of piston **46, 46*a*, is shown in its furthermost axial position within cylinder 42 as it begins to move in the direction of arrow 180. The other half of piston 46, 46*b*, is shown in the other furthermost axial position as piston 46 begins to move in the direction of arrow 182. With reference to piston half 46*a*, it can be seen that air supply port 122 is in communication with slot 80 and hence port 106. Passage 104 transports the compressed air to end 94 of piston 46 and thence out port 108 into end chamber 130. Vent 126 is covered by end seal 62. Hence, air pressure builds up in end chamber 130 thereby forcing piston 46 in the direction of arrow 180. As piston 46*a* moves, slot 80 moves past air supply port 122. When beveled wall 84 begins to move past air supply port 122, the volume of slot 80 in communication with air supply port 122 gradually decreases, thereby gradually slowing the rate air is being admitted to end chamber 130. Finally, main seal 56 completely covers air supply port 122 at the same time beveled end edge 74 of piston 46*a* comes into register with vent port 126. The end of piston 46*a* is beveled to permit a gradual, initial venting of end chamber 130. The momentum of piston 46*a* moves main seal 56 to the other side of air supply port 122 as shown by piston half 46*b*. As beveled wall 90 of slot 88 comes into register with air supply port 122, air is, at first, slowly admitted into passage 98 and then into end chamber 128 to cause a gradual breaking of piston 46*a*. Finally, as shown by piston 46*b*, slot 88 is in full communication with air supply port 122, thereby admitting full air flow to end chamber 128 and causing the reversal of piston 46*a*. At the same time, vent port 126 is completely uncovered, thereby permitting complete venting of end chamber 130, and vent port 122 is completely covered by end seal 60, thereby permitting full pressurization of end chamber 128. As mentioned above, air is supplied from the respective passages in piston 46 to the end seal and the main seal closest to the pressurized end chamber. This permits an adequate seal to be developed between piston 46 and inner surface 171 of cylinder 42** before air pressure is built up in the respective end chamber, thereby assuring less air leakage and a more efficient utilization of the compressed air.

It is apparent from the foregoing that a sander in accordance with the present invention is provided in which the piston itself replaces an air directing valve as shown in the prior art. Thus, a sander in accordance with the present invention can be manufactured less expensively, having a lighter weight, and have its motive fluid supply used more efficiently. In addition, the elimination of an air directive valve further produces a sander which has a longer, more trouble free service life.

Although the invention has been described in detail with respect to an exemplary embodiment thereof, it will be understood by those of ordinary skill in the art that variations and modifications may be effected within the scope and spirit of the invention.

I claim:

1. A fluid actuated portable sanding tool comprising:

a housing having a cylinder with a bore therein, means for supplying a pressurized fluid to a supply port in communication with said bore, and means for exhausting at least a first vent port and a second vent port in communication with said bore at corresponding first and second ends of said cylinder;

a double-ended piston slidably mounted for reciprocal movement within said cylinder, said piston having first circumferential main sealing means, a second circumferential main sealing means and a third circumferential main sealing means axially mounted along said piston at one end portion thereof for providing three slidable, fluid tight seals between said piston and the inner surface of said cylinder, thereby defining at said one end portion of said piston a first annular region and a second annular region respectively, said piston further having a first annular slot between said first and said second main sealing means and a second annular slot between said second and said third main sealing means, the walls of said first slot proximate said first main sealing means and the wall of said second slot proximate said third sealing means each extending substantially vertically radially inwardly, and the walls of said first and second slot proximate said second sealing means beveled angularly radially inwardly away from each other, a first port in communication with said first annular slot, a second port in communication with said second annular slot, a third port in communication with said cylinder bore at said first end of said cylinder, a fourth port in communication with said bore at said second end of said cylinder, a first passage in said piston in communication with said first port and said third port, and a second passage in said piston in communication with said second port and said fourth port, and wherein said fluid supply means supplies pressurized fluid at a central portion of said bore for alternate communication with said first port and said second port;

a first circumferential end sealing means and a second circumferential end sealing means respectively mounted at the first and second ends of said piston for providing slidable fluid tight seals between said piston and the inner surface of said cylinder and wherein said first vent port and said second vent port have a size and are spaced apart a distance such that each port is alternately blocked by the respective end sealing means when said piston is being forced away from said port by the pressurized fluid; and wherein said piston has an annular radially inwardly beveled edge at each end, said first and said second end seals being mounted axially inward from and adjacent to the corresponding beveled edge;

starter means for displacing said piston towards one end of said cylinder such that one of said first and second ports is in communication with said fluid supplying means;

a mounting plate mounted for reciprocal motion on said housing;

and means for connecting said piston at a location between said third main sealing means and said second end sealing means to said mounting plate for reciprocally driving said mounting plate;

wherein said piston is reciprocally driven by said fluid which has been alternately delivered from said supply means to the respective ends of said bore by said first port, first passage and third port and by said second port, second passage and fourth port.

2. A sanding tool as claimed in claim 1 wherein said connecting means comprises a first rack means carried by said mounting plate, a second rack means carried by said piston, and a pinion gear mounted on a stationary axis interposed between said first rack means and said second rack means whereby the movement of said piston, and hence said first rack means, in one direction drives said second rack means, and hence said mounting plate, in the other direction.

3. A sanding tool as claimed in claim 1 wherein each of said sealing means comprises a seal ring and wherein said piston further having additional passages therein in communication with said first passage and with the inner surfaces of said first end sealing means and said first main sealing means, and having further additional passages therein in communication with said second passage and with the inner surfaces of said second end sealing means and said third sealing means, said additional passages and said further additional passages for communication of said fluid to and from the corresponding sealing means respectively for expanding the corresponding seal rings into contacting relation with the inner surface of said cylinder and for venting the corresponding seal rings thereby reducing drag therefrom on the piston.

4. A sanding tool as claimed in claim 1 wherein said starter means comprises a spring means for resiliently urging said piston toward one end of said cylinder.

5. A sanding tool as claimed in claim 1 wherein said fluid supply means includes a supply valve and wherein said starter means comprises starter valve means and a passageway in said housing in communication with an end of said bore, said starter valve means momentarily operated during the initial operation of said fluid supply valve for, when operated, admitting the pressurized fluid to said passageway in said housing and to said end of said bore for displacing said piston toward the other end of said cylinder.

* * * * *